US005692690A

United States Patent [19]

Gulledge et al.

[11] Patent Number: 5,692,690

[45] Date of Patent: Dec. 2, 1997

[54] CABLE SNAGGER FOR WINDING A CONTINUOUSLY PRODUCED CABLE ONTO A TAKE-UP SPOOL

[75] Inventors: Danny Wilson Gulledge, Scottsboro, Ala.; Michael Edward Wall, Statesville, N.C.

[73] Assignee: CommScope, Inc., Catawba, N.C.

[21] Appl. No.: 584,172

[22] Filed: Jan. 11, 1996

[51] Int. Cl.[6] ..... B65H 54/00; B65H 75/28

[52] U.S. Cl. ..... 242/25 A; 242/125.1

[58] Field of Search ..... 242/25 A, 18 A, 242/125.1

[56] References Cited

U.S. PATENT DOCUMENTS

| | | | |
|---|---|---|---|
| 3,098,621 | 7/1963 | Nelson et al. | 242/25 A X |
| 3,994,058 | 11/1976 | Sasaki et al. | 242/125.1 X |
| 4,116,394 | 9/1978 | Smith et al. | 242/125.1 X |
| 4,437,617 | 3/1984 | Cardell | 242/18 PW X |
| 4,557,423 | 12/1985 | Zingler | 242/125.1 X |
| 4,883,230 | 11/1989 | Lindstrom | 242/25 A X |
| 5,251,834 | 10/1993 | Ikegami et al. | 242/25 A |
| 5,350,981 | 9/1994 | Taniguchi et al. | 242/25 A X |

FOREIGN PATENT DOCUMENTS

| | | | |
|---|---|---|---|
| 1 270 915 | 6/1968 | Germany | 242/25 A |

OTHER PUBLICATIONS

Hall Industries, Inc. Brochure, *Hall Handling Equipment*, 1990.

*Primary Examiner*—Michael Mansen

*Attorney, Agent, or Firm*—Bell, Seltzer, Park & Gibson, P.A.

[57] ABSTRACT

An apparatus for winding continuously produced cable about a take-up spool includes a frame, a traveler assembly, multiple take-up spool assemblies, and a translation system for automatically moving the traveler assembly into an aligned position with each spool assembly. The traveler assembly is movably mounted to the frame for receiving and for paying out continuously produced cable. Each spool assembly comprises a pair of opposing arms and a cable snagger. Each pair of opposing arms is configured to rotatably mount a spool therebetween. The cable snagger is secured to a member rotatably mounted on one arm and is configured to extend through an aperture in a flange of a spool in order to engage a free end of a continuously produced cable. A release mechanism for disengaging the snagger from the cable, once at least one wrap of the cable has been wound about the spool, is also provided.

16 Claims, 6 Drawing Sheets

CABLE SNAGGER FOR WINDING A CONTINUOUSLY PRODUCED CABLE ONTO A TAKE-UP SPOOL

FIELD OF THE INVENTION

This invention relates generally to the manufacturing of cable, such as coaxial cable, fiber optic cable, twisted pair copper communication cable, and other continuous filament cable, and more particularly, to an apparatus and method for winding continuously produced cable, such as coaxial cable, fiber optic cable, twisted pair copper communication cable, and other continuous filament cable, around a spool.

BACKGROUND OF THE INVENTION

Both coaxial and fiber optic cables are widely used in telecommunications for transmitting a variety of signals. A conventional coaxial cable typically includes a center conductor, a foam dielectric layer surrounding the center conductor, a foil shield layer surrounding the foam dielectric, a braided wire covering over the foil shield, and an overall protective plastic jacket. Such a conventional coaxial cable is disclosed in U.S. Pat. No. 4,894,488 to Gupta and U.S. Pat. No. 4,701,575 to Gupta et al., both of which are assigned to the assignee of the present invention.

A conventional fiber optic cable typically includes a core surrounded by an outer protective jacket. The core is typically formed of at least one buffer tube having a plurality of optical fibers in a loose-buffered relationship disposed therewithin, and one or more strength members. See, for example, U.S. Pat. No. 4,420,220 to Dean et al., U.S. Pat. No. 5,029,974 to Nilsson, and U.S. Pat. No. 5,138,685 to Arroyo et al.

A conventional coaxial cable is typically manufactured by first forming a core including the elongate center conductor over which a foam dielectric layer is extruded. The aluminum foil and braided wire covering are typically applied over the core during the braiding operation. Lastly, an overall plastic jacket is extruded over the braided wire layer. A conventional fiber optic cable is typically manufactured by first forming a core comprising at least one buffer tube having a plurality of optical fibers therewithin, and then surrounding the core with an outer jacket.

As described above, a plurality of separate and discrete steps are required during the manufacturing of both types of cables. While the various discrete steps are typically performed continuously, the production rate or throughput of each step, typically measured in feet per minute, is generally different. For example, braiding operations generally take much longer and, as a result, have a lower throughput than extrusion operations. Thus, the cable, after each step or series of steps, is wound on spools to await the next step. For example, the core of a cable is continuously manufactured, wound onto take-up spools, and transported to the next manufacturing step, such as the extrusion of an outer jacket thereabout. In addition, once the cable manufacturing process is complete, the finished cable must generally be wound about spools for storage, shipment and delivery.

Unfortunately, the present method of winding continuously produced cable onto take-up spools produces a rather large amount of scrap cable. The cable must typically be wrapped around the drum of the take-up spool and about itself several times before the cable is secured to the spool. As a result, the initial portion of the cable, often several feet in length, is often damaged by stretching and denting caused by the wrapping of the cable about itself. Poor electrical attenuation is often the result, thus rendering these portions of the cable unusable. During one production year, several feet of scrap cable per spool results in a significant and costly amount of scrap cable.

Additionally, cable is often produced at high rates of speed, often approaching eight-hundred (800) feet per minute. As a result of these high speeds, devices known as accumulators are required to permit continuous manufacturing while allowing the cable to be wound about or taken up on a number of spools wherein the winding of the cable is stopped briefly once each spool is filled in order to permit switching to another spool. The faster the throughput and the greater the delays incurred in changing spools, the larger the accumulator that is required. Unfortunately, as accumulators increase in size, the ability to maintain constant tension on a cable during manufacturing decreases, thereby increasing the risk of cable damage or production line malfunction.

SUMMARY OF THE INVENTION

It is therefore an object of the present invention to provide an apparatus and method of winding continuously produced cable about a take-up spool that reduces the amount of scrap cable produced during winding.

It is another object of the present invention to provide an apparatus and method of winding continuously produced cable about a take-up spool that reduces the size of an accumulator necessary to maintain high cable manufacturing throughput.

These and other objects are provided, according to one aspect of the present invention, by an apparatus for automatically winding continuously produced cable about a take-up spool without requiring the cable to wrap about itself in order to secure the cable to the spool. The apparatus comprises a frame, a traveler assembly, first and second take-up spool assemblies, and a translation system for moving the traveler assembly relative to the frame. The traveler assembly is movably mounted to the frame for receiving and for paying out continuously produced cable to a respective spool assembly. The traveler assembly further comprises a device for clamping and cutting the continuously produced cable when switching between spools.

The first and second take-up spool assemblies are positioned in respective predetermined positions relative to the frame. Each spool assembly comprises a pair of opposing arms and a cable snagger. Each pair of opposing arms is configured to rotatably mount a spool therebetween. At least one arm of the pair is adjustable relative to the frame in order to receive and rotatably engage a spool. Each spool assembly also includes a rotating member mounted to one arm and adapted to rotate with the spool mounted between the respective pair of arms. The cable snagger is, in turn, secured to the rotating member and configured to extend through an aperture in a flange of a spool so as to engage a free or leading end of a continuously produced cable.

Each one of the first and second take-up spool assemblies may also include a positioning system having means, such as a locator pin, for positioning the cable snagger in a predetermined position relative to the frame in order to automatically receive the leading end of the cable. The spool assemblies may also comprise an alarm that is activated when the cable snagger is not in the predetermined position. Likewise, the spool assemblies may include safety means for rendering the cable snagger incapable of engaging the leading end of the continuously produced cable when the cable snagger is not in the predetermined position.

Each one of the first and second take-up spool assemblies may further comprise a position determining system for determining the position of the cable snagger relative to the frame. A controller, responsive to the position determining system, is operably connected to the translation system such that the translation system can move the traveler assembly into operative alignment with the cable snagger of a respective take-up assembly based upon the position of the cable snagger as determined by the position determining means. The traveler assembly can then deliver a free end of a continuously produced cable to the cable snagger for engagement therewith.

The cable snagger preferably includes a gripper for securing the leading end portion of the cable to a spool while winding the cable thereabout. The gripper includes a body portion that extends through an aperture in the flange of a spool. The body portion holds the leading end portion of a cable via an aperture therethrough. The cable snagger can also include a release mechanism for disengaging the gripper from the leading end portion of a cable, once at least one wrap of the cable has been wound about the spool. The release mechanism may comprise a cutter for severing the leading end portion of the cable to thereby disengage the cable snagger from the cable.

An actuator, operatively connected to the gripper body portion, is provided for partially retracting the body portion through the flange aperture to a first position once the leading end portion of the cable has been inserted through the aperture defined by the body portion such that the cable leading end portion is secured to the spool prior to rotation of the spool. The actuator is also configured to move the body portion to a second position, typically by further retracting the body portion through the aperture defined by the spool flange, for cutting the cable prior to removing a full spool from the spool assembly. The actuator may be pneumatically controlled wherein a first pressure is supplied to move the body portion to a first position for gripping the cable, and a second, albeit greater, pressure is supplied to move the body portion to a second position for cutting the cable.

A process of winding continuously produced cable, according to the present invention, allows multiple take-up spools to be consecutively wound. According to this process, a first leading end portion of a continuously produced cable is aligned with a first spool. The first leading end portion of the cable is releasably secured to the first spool to facilitate winding the cable about the first spool. The first spool is then rotated to cause a predetermined amount of cable to wind thereabout. After winding at least one wrap of cable about the first spool, the first leading end portion of the cable is released, such as by cutting the first leading end portion, while continuing to wind cable about the spool. Once the predetermined amount of cable is wound about the first spool, the cable is cut to create a second leading end portion of the continuously produced cable. The second leading end portion of the continuously produced cable is then aligned with a second spool. The second leading end portion of the cable is releasably secured to the second spool to facilitate winding the cable about the second spool in the same manner described above in conjunction with the first spool.

As described above, the present invention is advantageous because the amount of scrap cable caused by damage during winding is reduced significantly since the take-up apparatus secures the cable to the spool by gripping a leading end of the cable, as opposed to winding the cable about itself. Furthermore, the present invention reduces the need for large accumulators, otherwise necessary to maintain high cable manufacturing throughput, since the take-up apparatus of the present invention can rapidly and automatically switch between spools without significantly delaying winding operations.

DETAILED DESCRIPTION OF PREFERRED EMBODIMENTS

The present invention now is described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Figures 1, 2:
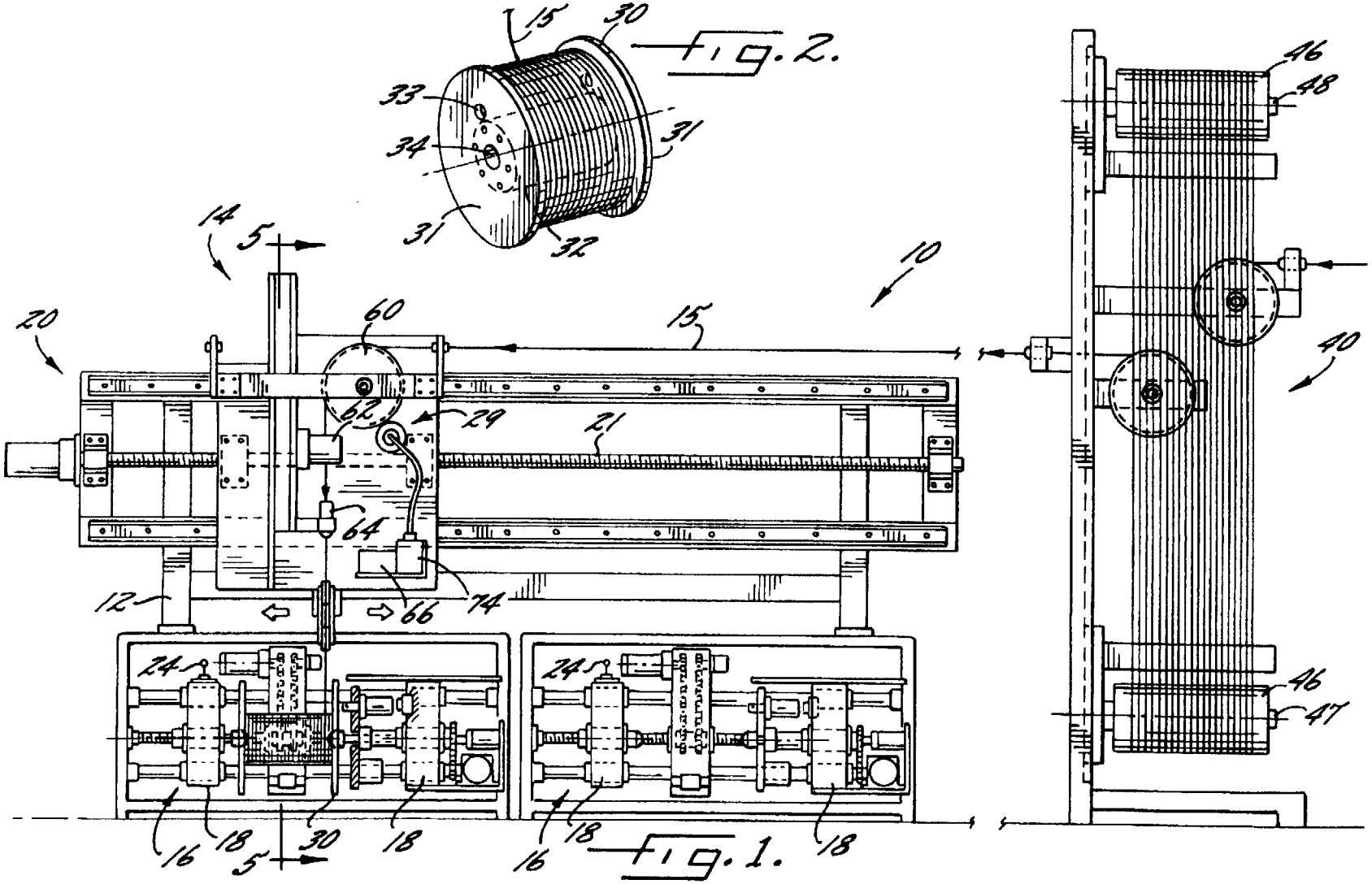
FIG. 1 is a front plan view of a cable take-up apparatus having a cable snagger on each spool assembly, according to the present invention.
FIG. 2 is a perspective view of a take-up spool configured to be used with the apparatus illustrated in FIG. 1.

Referring now to FIG. 1, a cable take-up apparatus 10 for winding continuously produced coaxial or fiber optic cable about a take-up spool, according to the present invention, is illustrated. It shall be understood that the term "cable" as used herein, shall include coaxial cable, fiber optic cable, twisted pair copper communication cable, and other continuous filament cables, and shall also include each of these types of cables in their various manufacturing stages. In the illustrated embodiment, a frame 12 is configured to support a traveler assembly 14 for receiving and paying out continuously produced cable 15 to a pair of take-up spool assemblies 16 positioned therebelow. However, the take-up apparatus can have any number of spool assemblies without departing from the spirit and scope of the present invention. In one embodiment, the frame and traveler assembly can include the frame and traveler assembly of the dual-spool take-up machine manufactured by Hall Industries, Inc., and modified according to the present invention. However, the present invention can be employed in conjunction with a variety of other cable take-up machines having any number of spools.

An accumulator 40, such as manufactured by Hall Industries, inc., is positioned adjacent the cable take-up apparatus 10 and permits the traveler assembly 14 to move between take-up spool assemblies without interrupting the cable production upstream. The accumulator 40 generally includes a pair of pulley sets 46 rotatably mounted on first 47 and second 48 opposed axles. Typically, the first axle 47 is fixed and the second axle 48 is movable towards and away from the first axle 47. The cable 15 is passed around each of the pulleys 46 so that a considerable length of cable, roughly equal to the number of pulleys 46 multiplied by the distance between the axles 47,48, can be accumulated and later discharged. To accumulate the cable 15 in the illustrated embodiment, the second axle 48 is moved away from the first 47, and to discharge the cable the second axle 48 is moved towards the first 47. During changeover from one take-up spool assembly 16 to the other, the accumulator 40 generally receives a constant and uninterrupted supply of cable 15 which is stored for subsequent discharge during the winding of the next spool. It would readily be understood by one skilled in the art that the accumulator capacity is governed by the cable speed and the time required to switch over from one take-up spool to another.

Each spool assembly 16 is configured to receive a spool 30 around which a predefined amount of the continuously produced cable 15 is wound. Referring now to FIG. 2, an exemplary take-up spool 30, for use with the cable take-up apparatus 10, is illustrated. The spool 30 comprises a pair of opposing flanges 31 and a drum 32 positioned therebetween, around which the cable 15 is wound. An aperture 33 is provided in at least one of the flanges 31 and is configured to receive a cable snagger 52 (described in detail below) therethrough. The aperture 33 is preferably located adjacent the drum 32. Another aperture 34 is provided in each flange in alignment with the axis of rotation of the spool, as illustrated. Each of these axially aligned apertures 34 is configured to receive a spindle adapter to facilitate rotation of the spool, as described below.

As known to those skilled in the art, typical spool widths range from about twenty-two inches (22") to thirty-six inches (36") between opposing flanges. In addition, a spool drum generally has a diameter of about ten and one-half inches (10½"). However, the take-up apparatus and, more particularly, the spool assembly of the present invention, can receive and utilize spools of other dimensions without departing from the spirit and scope of the present invention.

Figure 3:
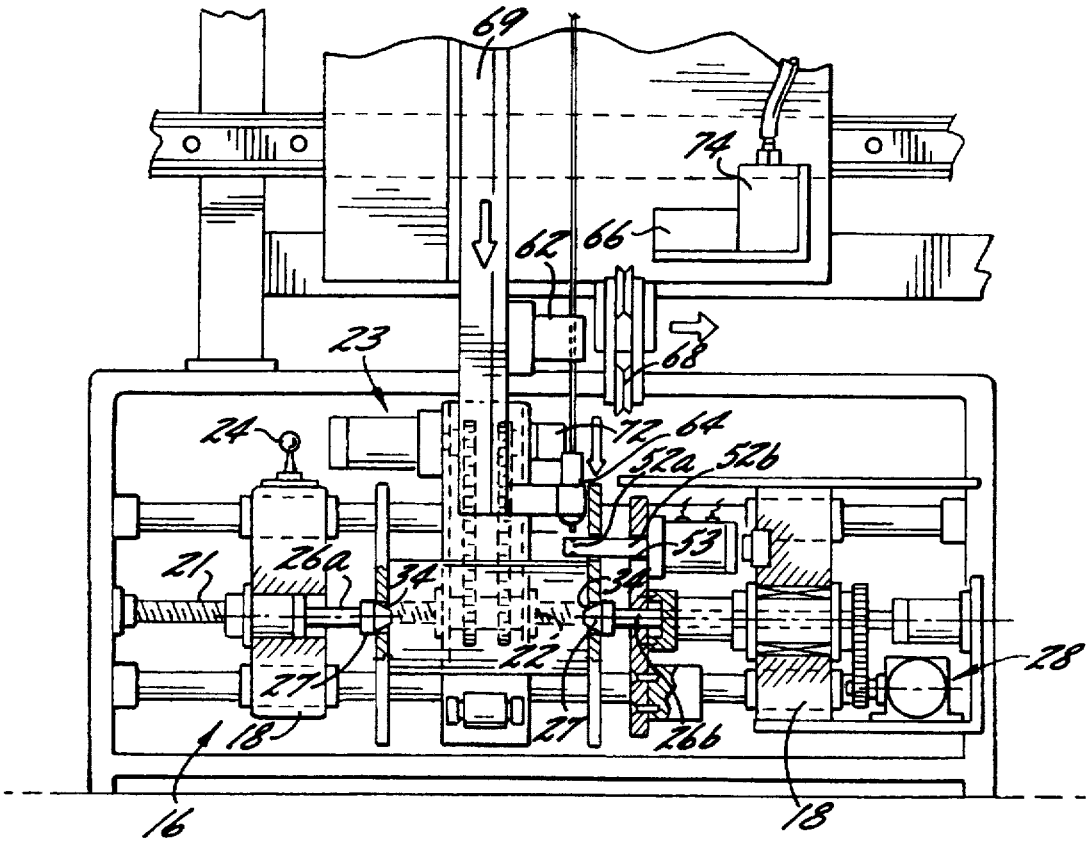
FIG. 3 is a partial front plan view of the cable take-up apparatus of FIG. 1 depicting a take-up spool assembly in more detail.

Referring now to FIG. 3, a take-up spool assembly 16 is described in detail. The spool assembly 16 includes a pair of opposing arms 18 configured to rotatably mount a take-up spool 30 therebetween. The spool assembly also includes a cable snagger assembly 50 operably connected to one of the arms 18 for engaging the free or leading end of a cable 15 to be wound around the spool 30. In the illustrated embodiment, each arm 18 is generally rectangular in shape and has a first and second end portion **18*a* and 18*b*, respectively. The lateral distance between each opposing arm 18 is adjustable to accommodate take-up spools of varying size. This lateral adjustment is provided by a pair of left-hand and right-hand screws 21 and 22, respectively, driven by a reversible gear motor and torque limiter assembly 23. Preferably, both arms 18** move simultaneously inwardly or outwardly when a lateral adjustment is made. However, the spool assembly could include a first arm which is fixed in position and a second arm which is laterally adjustable to accommodate take-up spools of varying size without departing from the spirit and scope of the present invention.

Both arms 18 are also configured to move in tandem upwards and downwards to facilitate mounting and dismounting a spool 30 therebetween. This upward or downward movement of the arms can be performed in any manner known to those skilled in the art, such as mechanically, pneumatically or hydraulically. To load a spool 30, both arms 18 are moved downwardly such that the spool can be rolled into position between the arms. Once the spool 30 is properly mounted, both arms 18 are raised simultaneously to a position sufficient to allow the spool to rotate freely. To dismount a spool, the above operation is reversed. Preferably, a single control lever 24 is used to adjust the lateral and vertical movement of the arms 18.

A spool 30 is mounted between each pair of opposing arms 18 via a pair of opposing spindles **26*a*,26*b*, each rotatably mounted within the end portion of a respective arm 18. Preferably, each spindle 26*a*,26*b* has a replaceable adapter 27 configured to be received within and operatively engage an axially aligned aperture 34 in a spool flange 31, as illustrated in FIG. 3. A variety of adapters of different sizes and shapes can be selectively mounted on a respective spindle in order to effectively mate with axially aligned apertures 34 having a corresponding size and shape. Typically, one spindle 26*b* is the drive spindle and, when rotated, causes the spool 30 to rotate due to its operative engagement therewith. Preferably, the drive spindle 26*b* is rotated via an electric motor assembly 28, as illustrated in FIG. 3**.

Figure 4:
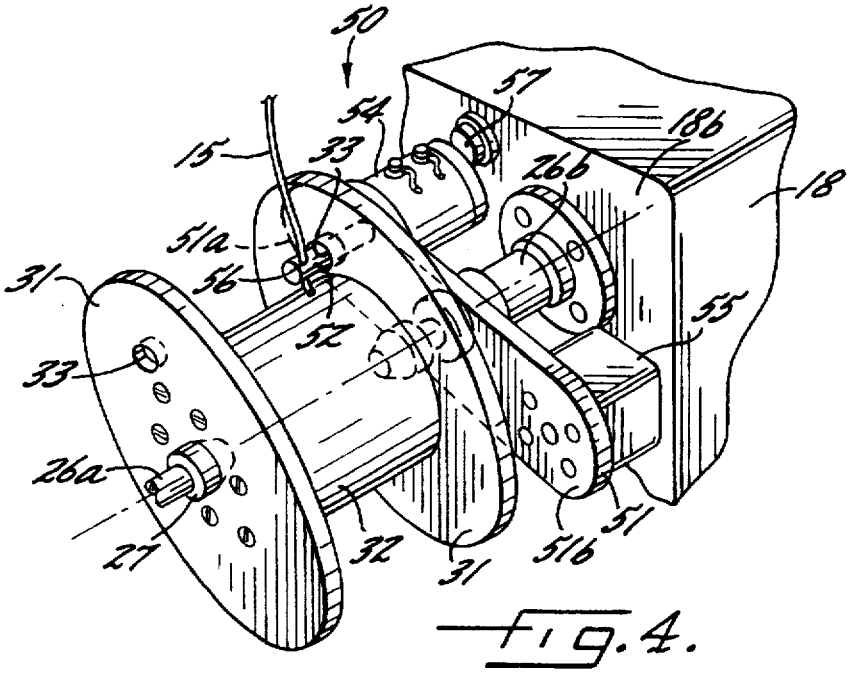
FIG. 4 is a partial perspective view of a take-up spool assembly illustrating the extension of the cable snagger through an aperture defined by a flange of the take-up spool, according to the present invention.

Referring now to FIG. 4, the cable snagger assembly 50, according to the present invention, will be described in detail. The cable snagger assembly 50 includes a rotating member 51 mounted on the drive spindle **26*b* and having opposing first and second end portions 51*a*,51*b*. The cable snagger assembly 50 also includes a cable snagger 52 and actuator 54 mounted to the first end portion 51*a* of the rotating member, and a counter-weight assembly 55 mounted to the second end portion 51*b* of the rotating member. The counter-weight assembly 55 provides balance when the cable snagger assembly 50** is rotated during winding, as will be described in detail below.

Figure 8A:
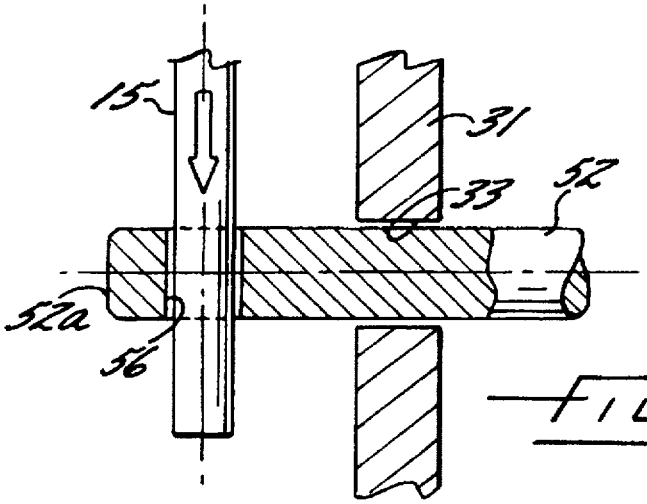
FIGS. 8A, 8B and 8C illustrate the cable snagger of one embodiment of the present invention in the engaging, first retracted and second retracted positions, respectively.
Figure 8B:
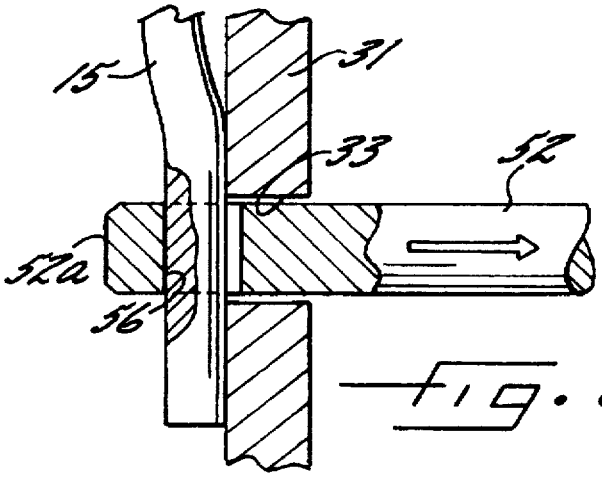

The cable snagger 52 includes a body portion, such as a slender rod, having first and second end portions **52*a*,52*b*. The cable snagger first end portion 52*a* has a bore 56 therethrough that is generally perpendicular to the longitudinal axis of the lengthwise extending body portion, as illustrated in FIG. 4. The bore has a diameter sufficiently large enough to permit the leading end of a cable 15 to pass therethrough without restriction. As shown in FIG. 8A, the first end portion 52*a* can extend through an aperture 33 defined in the flange 31 of the spool 30. The cable snagger second end portion 52*b* is retractably mounted within an actuator assembly 54 which, in turn, is mounted to the side of the rotating member 51 facing the supporting arm 18 and opposite the spool 30. The actuator assembly 54 is configured to move the cable snagger between an engaging position as shown in FIG. 8A in which the first end portion 52*a* extends through the corresponding aperture 33 in the spool flange 31 to permit the leading end of a cable to be threaded through the bore 56, to a first retracted position as shown in FIG. 8B in which the first end portion is at least partially withdrawn into the aperture 33 in the spool flange 31 so as to secure the cable to the flange. The actuator assembly 54 is also configured to move the cable snagger first end portion 52*a* to a second retracted position for cutting the leading end of the cable, as shown in FIG. 8**C and described in greater detail below.

Preferably, the cable snagger actuator assembly 54 is a pneumatically controlled actuator. Typically, a pressure of about fifteen (15) pounds per square inch (psi) is sufficient to move the cable snagger first end portion 52a, with the leading end of a cable 15 secured thereto, to the first retracted position. Typically, a pressure of about ninety (90) psi is required to move the cable snagger first end portion 52a to a second retracted position for cutting the cable 15. However, as would be known by those having skill in the art, the pressure necessary to move the cable snagger first end portion 52a to the first and second retracted positions will depend on, among other things, the size and type of cable being wound about the spool 30.

The take-up spool assembly also includes positioning means, such as a locator pin, for properly positioning the cable snagger 52 in a predetermined position relative to the frame while the leading end of the cable is inserted through the aperture defined by the body portion of the cable snagger. As illustrated in FIG. 4, a locator pin 57 is retractably secured to the same arm 18 that supports the cable snagger assembly 50. The locator pin is preferably actuated by a pneumatically controlled actuator (not shown) and is movable between a retracted and engaged position. The purpose of the locator pin 57 is to maintain the cable snagger 52 in its proper, i.e., predetermined, position during the threading of the cable leading end. When the cable snagger 52 is properly positioned for receiving the leading end of a cable, the cable snagger is aligned with the locator pin 57 such that the locator pin can be extended toward and into engagement with an aperture (not shown) in the cable snagger, more particularly, the actuator assembly 54, thereby maintaining the cable snagger 52 in the proper position for receiving the cable leading end. Preferably, both the extension of the snagger first end portion 52a into the corresponding aperture 33 in the spool flange 31, and the extension of the locator pin 57 occur generally simultaneously as part of the spool mounting operations described hereinbelow.

The spool assembly 16 and, more preferably, the positioning means can include means, such as an alignment sensor 80, for determining if the cable snagger 52 is not properly positioned for receiving the leading end of a cable 15. For example, if the cable snagger is improperly positioned, the locator pin 57 will generally be extended either too far, i.e., overtravel, or too little, i.e., undertravel, upon actuation thereof. Thus, the positioning means can include an alignment sensor mounted upon the pneumatic cylinder associated with the locator pin to detect the overtravel or undertravel of the locator pin and, as a result, to detect the improper positioning of the cable snagger. If the positioning means does detect that the cable snagger is improperly positioned, the locator pin 57 will be withdrawn to its retracted position. In addition, the spool assembly 16 can include an alarm 76 which is activated if the take-up machine operator tries to initiate threading a cable into the snagger 52 if the rotating member 51 is not properly positioned and has not been engaged by the locator pin 57. As yet another safeguard, the take-up spool assembly can include safety means 78 for retracting the cable snagger 52 from the flange aperture 33 to thereby render the cable snagger incapable of engaging the leading end of a cable 15, if the rotating member 51 is not properly aligned with the locator pin 57 when the operator attempts to thread the leading end of the cable into the cable snagger.

Referring back to FIG. 1, the traveler assembly 14 travels between each take-up spool assembly 16 via a translation table assembly 20 of the type conventionally used with cable take-up machines. In general, the translation table assembly comprises a screw 21' and electric motor-driven gear system 29. The take-up apparatus also includes a controller 70 (FIG. 7) for controlling, among other things, the position of the traveler assembly 14 relative to each spool assembly 16, as will be described below.

The traveler assembly 14 generally includes a pulley 60 over which a cable 15 is received from the accumulator 40, a clamp 62, a guide block 64, a pinch cutter 66, a pair of guide pulleys 68, and a threader bar 69. The threader bar 69 supports the clamp 62 and the guide block 64, and is movable vertically, with respect to the spool assembly 16, from a winding position to a threading position, as shown in FIGS. 3A–3D and described above.

The clamp 62 is located downstream from the pulley 60, and is adapted to grip the cable 15. Preferably, the clamp is hydraulically operated. Downstream from the clamp 62 is a guide block 64 for guiding the leading end of a cable 15 into the bore 56 of the cable snagger 52. Preferably, the guide block 64 has an internal bore (not shown) of sufficient diameter to facilitate threading of a cable therethrough. In a particularly preferable embodiment, the bore of the guide assembly 64 is generally conical, and has a cross-sectional shape which decreases in size in the direction of movement of the cable.

Downstream from the guide block 64 is a conventional pinch cutter 66 for severing the cable 15 prior to moving from one spool assembly to the other. The pinch cutter is movably mounted on the traveler assembly 14 such that it can be moved away from the cable 15 during threading and winding, and moved towards the cable to sever the cable. Preferably the pinch cutter 66 is hydraulically operated. Also, preferably the cutter 66 has a blade life of at least one year, based on one (1) cut every thirty (30) minutes for twenty-four (24) hours per day for three-hundred-fifty (350) days. Downstream from the pinch cutter 66, are a pair of guide pulleys 68 for maintaining proper alignment and tension on the cable 15 during winding. The guide pulleys are movably mounted on the traveler assembly 14 such that they can be moved laterally and away from the cable 15 during threading.

Figure 7:
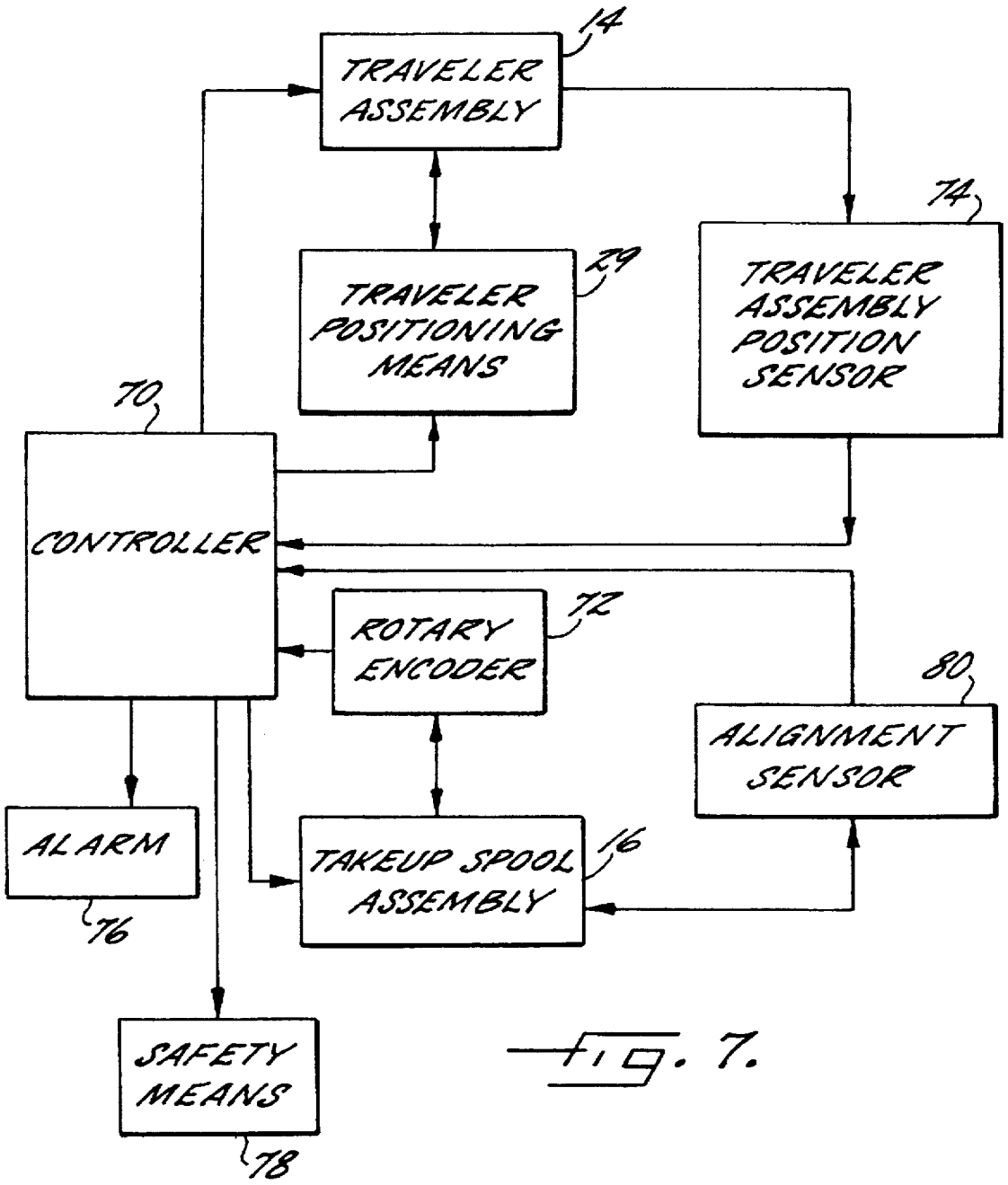
FIG. 7 is a schematic diagram of the system for controlling the position of the traveler assembly relative to each cable snagger.

Referring now to FIG. 7, a schematic diagram of the system for controlling the position of the traveler assembly 14 relative to each spool 30 and, more particularly, relative to each cable snagger 52 is illustrated. In particular, each take-up spool assembly 16 includes position determining means, such as a rotary encoder 72, for determining the location of the respective cable snagger 52 relative to the frame 12. In the illustrated embodiment of FIG. 3, the rotary encoder 72 is located adjacent the reversible gear motor and torque limiter assembly 23, and is adapted to measure the number of turns made by the left-hand and right-hand screws 21 and 22. By measuring the number of turns each screw has made, the position of each arm 18, and thus the position of the cable snagger 52 mounted to one of the arms, can be determined relative to the frame 12. However, the position determining means can include other devices for determining the location of the respective cable snagger relative to the frame without departing from the spirit and scope of the present invention.

Still referring to FIG. 7, the position control system includes a controller 70, such as an Allen-Bradley Model PLC5, which receives input from the rotary encoder 72 of each take-up spool assembly and from the traveler assembly position sensor 74. The traveler assembly position sensor 74 is preferably a magnetic position sensor mounted on the traveler assembly 14, as illustrated in FIG. 3 for determining the position of the traveler assembly and, more particularly, the leading end of the cable relative to the frame. Based upon the input from the magnetic sensor 74 and the rotary encoder 72, the controller 70 can control the position of the traveler assembly 14 relative to each spool assembly 16 and the respective cable snaggers 52 via the screw 21 and gear system 29 of the traveler assembly. Thus, the controller can position the traveler assembly above a spool assembly such that the threader bar 69 is aligned with the bore 56 defined by the cable snagger, as described in detail below.

The process of winding continuously produced cable 15 about multiple, consecutive take-up spools 30, utilizing the apparatus 10 of the present invention, will now be described. Initially, an empty take-up spool 30 is mounted in each spool assembly 16 by lowering each respective pair of arms 18 sufficiently to allow each spool to be rolled into position. Once each spool 30 is in position, the opposing arms 18 of each respective pair are moved towards each other so that each spindle adapter 27 is properly seated within a respective spool flange aperture 34. Once properly mounted, each pair of arms 18 is then raised upwards to permit rotation of each respective spool 30.

Beginning with either one of the spool assemblies 16, the rotating member 51 and/or the spool 30 is rotated by hand until both the cable snagger 52 is aligned with the spool flange aperture 33, and the rotating member 51 is aligned with the locating pin 57. When proper alignment is achieved, the operator actuates the cable snagger 52, such as by depressing a predetermined button. Upon actuation of the cable snagger, the controller 70 extends the cable snagger into the spool flange aperture 33 as shown in FIG. 8A, and simultaneously extends the locator pin 57 to its engaged position. If proper alignment of either the rotating member 51 with the locator pin 57, or the cable snagger 52 with the spool flange aperture 33 has not been achieved, the positioning means and, more particularly, the alignment sensor 80 will detect the misalignment as described above and will notify the controller which, in turn, can activate an alarm 76 when the operator attempts to thread the leading end of the cable through the bore 56 of the cable snagger. The controller is also operatively connected to the safety means 78 as shown in FIG. 7 which is adapted to retract the first end portion of the cable snagger through the spool flange aperture 33 to thereby prevent the cable snagger from gripping the cable leading end if cable snagger is improperly aligned when the operator attempts to thread the leading end of the cable through the bore 56 of the cable snagger. Once a first spool has been properly aligned and locked into position, these spool alignment procedures can be repeated for the other spool assembly 16.

At start-up, once proper alignment is obtained as described above, the cable 15 is manually threaded around the traveler assembly pulley 60, through the clamp 62, and through the guide block 64. The leading end of the cable 15 is then manually inserted through the bore 56 of the cable snagger 52. Once the leading end of the cable 15 is inserted, the cable snagger 52 is actuated by the operator and, under control of the controller 70, moves to its first retracted position whereupon the cable leading end portion is pulled tightly against the flange 31 of the spool 30, as shown in FIG. 8B. The pressure imparted to the cable 15 to hold it in place against the spool flange 31 is sufficient to permit the cable to be wound about the spool without slipping, and without stretching or otherwise damaging the cable.

Once the cable snagger 52 has moved to its first retracted position, the controller 70 automatically retracts the locating pin 57 and begins to rotate the first spool 30 by rotating the drive spindle 26*b* via the electric motor assembly 28 such that the cable 15 is wound around the spool drum 32. Preferably, the spool 30 is rotated at a speed sufficient to reduce, but not deplete, the amount of accumulated cable stored by the accumulator 40. In addition, the controller generally moves the traveler assembly 14 back and forth across the spool drum 32 during winding operations in a manner known to those skilled in the art. When the first spool 30 is full, or when a predefined length of cable has been wound thereabout, the controller ceases rotation of the spool and the stops the advancing cable by actuating the clamp 62. However, as would be understood by those having skill in the art, the cable is still being produced upstream, and the accumulator 40 continues to store the excess cable. The controller then actuates the pinch cutter 66 which moves laterally along the traveler assembly 14 to engage and sever the cable 15 to thereby produce a new leading end.

Figure 8C:
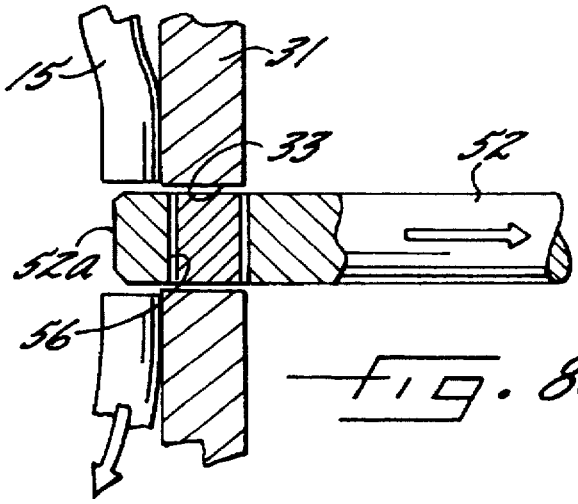

The controller 70 then actuates the cable snagger 52 again so as to move the cable snagger to its second retracted position as shown in FIG. 8C. The force of the cable 15 against the spool flange 31 when the cable snagger 52 is retracted to its second retracted position is sufficient to shear or cut the cable, thereby releasing the cable from the cable snagger. While the cable snagger 52 can be moved to its second retracted position following winding operations, the cable snagger may, instead, be moved to its second retracted position after at least one wrap of cable has been wound about the spool 30.

Referring now to FIGS. 3A–3D, the procedure for automatically winding a cable about another spool 30, such as a second or third consecutive spool, once the cable take-up apparatus 10 is in operation, is illustrated. When the initial spool 30 is full and the cable 15 has been cut by the pinch cutter 66, the controller automatically moves the traveler assembly 14 into alignment with the cable snagger 52 of the next take-up spool assembly 16. As described above, the cable snagger 52 of the next spool assembly has been extended through the flange aperture 33 of a spool, and the locator pin 57 has engaged the rotating member 51 to lock the cable snagger in the predetermined position.

Figure 3A:
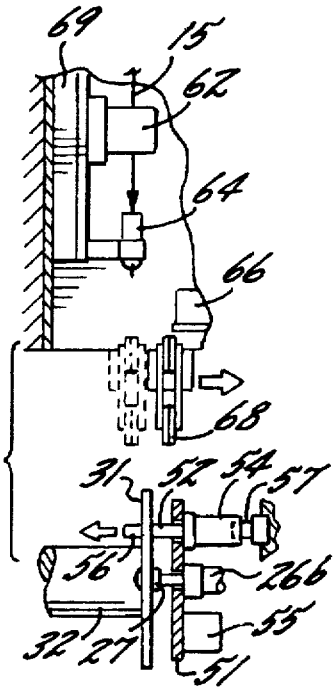
FIGS. 3A, 3B, 3C, and 3D illustrate the positions of the threader bar before, during, and after threading a cable leading end into a cable snagger.
Figure 3B:
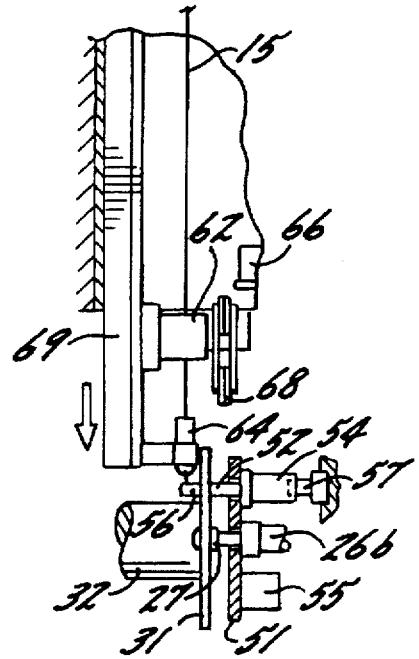
Figure 3C:
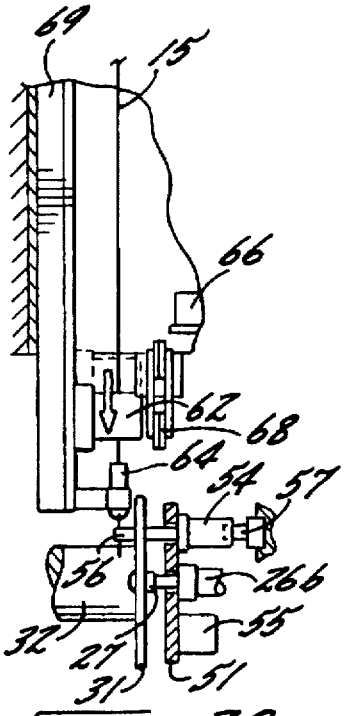
Figure 3D:
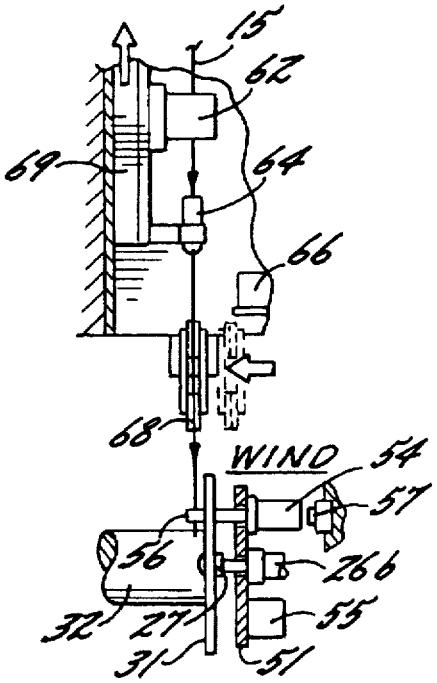

Once the traveler assembly 14 is aligned with the cable snagger 52, the controller 70 moves the guide pulleys 68 away from the cable 15, as shown in FIG. 3A. The controller then moves the threader bar 69 down towards the cable snagger 52, such that the guide block 64 is just above the cable snagger, as shown in FIG. 3B, so that the leading end of the cable 15 is just above the cable snagger bore 56. While the guide block is typically moved to within an inch or less of the cable snagger, the guide block can be spaced at other distances from the cable snagger without departing from the spirit and scope of the present invention. The controller then moves the clamp 62, which is gripping the cable 15, downwardly towards the guide block 64, as shown in FIG. 3C, thereby causing the leading end of the cable 15 to be inserted into the snagger bore 56. After the cable leading end is inserted into the cable snagger bore 56, the controller then causes the snagger 52 to grip the cable by moving the cable snagger to its first retracted position (FIG. 8B). The controller then releases clamp 62 and moves the clamp upwards away from the guide block 64. The clamp 62 does not grip the cable again until it is time to sever the cable and move the traveler assembly 14 to another spool assembly 16, as will be described below. The controller then moves the threader bar 69 upwards to its winding position and returns the guide pulleys 68 to alignment with the cable 15, as shown in FIG. 3D, such that the spool 30 is ready to be rotated to wind cable 15 thereabout.

Figure 5:
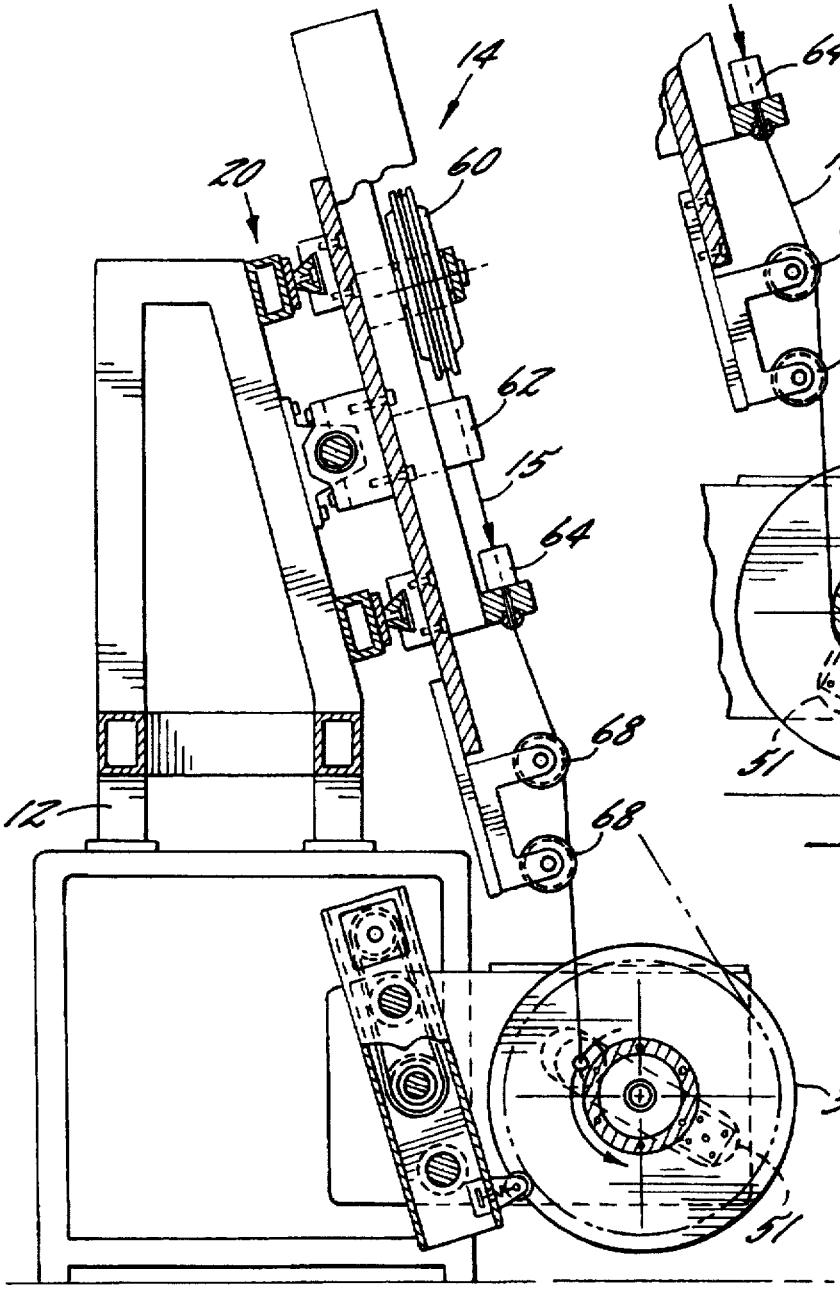
FIG. 5 is a cross-sectional view of the cable take-up apparatus illustrated in FIG. 1, illustrating a cable threaded into the snagger and the threader bar in its winding position.
Figure 6:
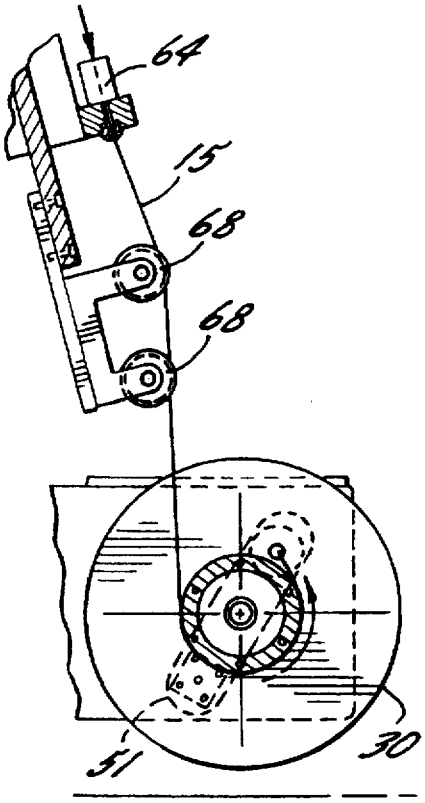
FIG. 6 is a partial cross-sectional view of the cable take-up device illustrated in FIG. 1, illustrating the rotation of the spool and cable snagger.

As described above in conjunction with FIG. 3D, FIG. 5 is a cross-sectional view of the cable take-up device 10, showing the cable 15 engaged in a cable snagger 52, and the threader bar in its winding position. The controller 70 then rotates the second spool 30 by rotating the drive spindle 26b via the electric motor assembly 28 as shown in FIG. 6. The cable 15 is wound around the spool drum 32 until full, or until a predefined length of cable has been wound in a like manner to that described above in conjunction with the first spool.

Prior to the second spool becoming full, the first spool is unloaded from the first spool assembly and another empty spool is mounted and aligned according to the above procedures, i.e., the cable snagger 52 is aligned with both the locator pin 57 and the aperture 33 defined by the cable flange. Once the second spool becomes full and is stopped from rotating, the controller 70 actuates the traveler assembly clamp 62 to grip the cable and moves the pinch cutter 66 laterally to engage and cut the cable 15. The controller then automatically moves the traveler assembly into proper alignment with the cable snagger 52 of the other spool assembly. As described above, the controller can then move the threader bar 69 downwards such that the leading end of the cable 15 is threaded through the bore 56 of the cable snagger 52. The above procedure is repeated between the spool assemblies 16 as long as the cable 15 is being produced.

The cable transfer process, from spool to spool, is gentle on the cable since the cable is not wound upon itself in order to secure the cable to the rotating spools. Thus, minimal scrap cable is generated during initial winding. In addition, the take-up apparatus of the present invention can be employed on virtually any type and size of spool. Furthermore, the cable take-up apparatus 10, according to the present invention, is capable of running different size spools in sequence. Moreover, the take-up apparatus of the present invention automatically shifts to an empty spool and resumes winding operations upon filling a first spool, thereby reducing spool changeover time and correspondingly reducing the amount of continuously produced cable which must be accumulated, thereby decreasing the required size of the accumulator.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed:

1. An apparatus for winding continuously produced cable about a take-up spool having a pair of opposed flanges, said apparatus comprising:

a frame;

a traveler assembly movably mounted to said frame for receiving and for paying out continuously produced cable;

first and second take-up spool assemblies positioned in a predetermined position relative to said frame, each spool assembly comprising:

a pair of opposing arms configured to rotatably mount a spool therebetween, wherein at least one arm of said pair is adjustable relative to said frame in order to receive and rotatably engage the spool; and a cable snagger operably connected to one of said pair of opposing arms so as to rotate therewith during cable winding operations, said cable snagger comprising a body portion and actuation means for extending at least a portion of the body portion through an aperture in a flange of the spool such that the body portion engages a free end of the continuously produced cable between the flanges of the spool, the actuation means continuing to extend the body portion of the cable snagger through the aperture in the flange of the spool during winding of at least one wrap of cable about the spool; and translation means for moving said traveler assembly relative to said frame and into operative alignment with the cable snagger of a respective take-up spool assembly such that said traveler assembly delivers the free end of the continuously produced cable to said cable snagger for engagement therewith.

2. An apparatus according to claim 1, wherein each one of said first and second take-up spool assemblies further comprises position determining means for determining the position of the cable snagger relative to the frame.

3. An apparatus according to claim 2, further comprising a controller responsive to said position determining means, said controller operably connected to said translation means for determining the position of said cable snagger relative to said traveler assembly to facilitate alignment of said cable snagger and said traveler assembly.

4. An apparatus according to claim 1, wherein said cable snagger is secured to a member rotatably mounted on one arm of said pair of arms, said member configured to rotate with a spool mounted between said pair of arms.

5. An apparatus according to claim 1, wherein each one of said first and second take-up spool assemblies further comprises means for positioning the cable snagger in a predetermined position.

6. An apparatus according to claim 5, wherein said positioning means comprises an alarm that is activated upon attempted delivery of the free end of the cable to the cable snagger if the cable snagger is not in the predetermined position.

7. An apparatus according to claim 5, wherein said positioning means comprises safety means for rendering the cable snagger incapable of engaging the free end of a continuously produced cable upon attempted delivery of the free end of the cable to the cable snagger if the cable snagger is not in the predetermined position.

8. An apparatus according to claim 1, wherein said traveler assembly comprises means for clamping and cutting continuously produced cable.

9. An apparatus according to claim 1, further comprising means for accumulating continuously produced cable upstream from said traveler assembly.

10. A cable snagger for holding a leading end portion of a continuously produced cable while the cable is wound about a spool having a pair of opposed flanges, the cable snagger comprising:

gripping means for securing the leading end portion of the cable to the spool while the cable is wound about the spool, said gripping means comprising a body portion and actuation means, operatively connected to said body portion, for extending at least a portion of said body portion through an aperture in a flange of the spool such that said body portion engages the leading end portion of the cable between the flanges of the spool, said actuation means also at least partially retracting said body portion to a first position such that the leading end portion of the cable is securely held against the flange of the spool during winding of at least an initial wrap of cable about the spool; and releasing means, operatively connected to said gripping means, for disengaging said gripping means from the leading end portion of the cable once at least one wrap of the cable has been wound about the spool.

11. A cable snagger according to claim 10, wherein said body portion has an aperture therethrough for receiving the leading end portion of the cable.

12. A cable snagger according to claim 10, wherein said actuation means comprises pneumatic control for extending and retracting said body portion.

13. A cable snagger for holding a leading end portion of a continuously produced cable while the cable is wound about a spool having a pair of opposed flanges, the cable snagger comprising:

gripping means for securing the leading end portion of the cable to the spool while the cable is wound about the spool, said gripping means comprising a body portion and actuation means, operatively connected to said body portion, for extending at least a portion of said body portion through an aperture in a flange of the spool such that said body portion engages the leading end portion of the cable between the flanges of the spool; and releasing means, operatively connected to said gripping means, for disengaging said gripping means from the leading end portion of the cable once at least one wrap of the cable has been wound about the spool, wherein said releasing means also comprises said actuation means which retracts said body portion to a second position outside of said spool in which said body portion is completely withdrawn from the aperture in the flange of the spool, wherein the leading end portion of the cable is severed as said actuation means retracts said body portion through the aperture to thereby disengage the cable snagger from the cable.

14. A method for winding continuously produced cable about each one of a plurality of spools in consecutive order, said method comprising the steps of:

aligning a first leading end portion of a continuously produced cable with a first spool;

releasably securing the aligned first leading end portion of the cable to the first spool to facilitate winding the cable about the first spool;

rotating the first spool to cause a predetermined amount of the releasably secured cable to wind thereabout;

releasing the first leading end portion of the cable during said rotating step after winding at least one wrap of cable about the first spool such that additional cable is wound about the first spool following the release of the first leading end portion of the cable;

cutting the cable, following the winding of the predetermined amount of cable about the first spool, to create a second leading end portion of the continuously produced cable;

aligning the second leading end portion of the continuously produced cable with a second spool; and releasably securing the aligned second leading end portion of the cable to the second spool to facilitate winding the cable about the second spool.

15. A method according to claim 14, wherein said step of releasing the first leading end portion comprises cutting the first leading end portion of the cable.

16. A method according to claim 14 wherein said step of releasably securing the first leading end portion of the cable comprises securely holding the first leading end portion of the cable against a flange of the first spool while winding of at least one initial wrap of cable about the first spool.

* * * * *